US005479842A

United States Patent [19]

Ostermeyer

[11] Patent Number: 5,479,842

[45] Date of Patent: Jan. 2, 1996

[54] FLAVORED MUSICAL INSTRUMENT REEDS

[76] Inventor: Walter H. Ostermeyer, 2415 Forest Park Blvd., Fort Wayne, Ind. 46805

[21] Appl. No.: 176,096

[22] Filed: Dec. 30, 1993

[51] Int. Cl.[6] ..... G10D 9/02; B05D 3/02

[52] U.S. Cl. ..... 84/383 A; 427/388.4

[58] Field of Search ..... 84/383 A, 380 A, 84/383 R; 427/392, 442, 388.4

[56] References Cited

U.S. PATENT DOCUMENTS 4,835,002 5/1989 Wolf et al. ..... 426/590

4,856,405 8/1989 Humphrey ..... 84/383 A

*Primary Examiner*—Cassandra C. Spyrou

*Attorney, Agent, or Firm*—Lundy and Associates

[57] ABSTRACT

A reed for a musical instrument comprising a reed body having opposite ends. One end being adapted to be mounted in a mouthpiece of a musical instrument. The other end is tapered from a position remote of the one end toward the other end to give to the reed the required stiffness adjacent the other end. A flavoring is absorbed into the reed body. The flavoring being concentrated at the other end.

18 Claims, 1 Drawing Sheet

FLAVORED MUSICAL INSTRUMENT REEDS

BACKGROUND OF THE INVENTION

The present invention pertains generally to musical instrument reeds such as those used with woodwind instruments, and more particularly to a flavored musical instrument reed.

Musical instrument reeds have been provided for woodwind instruments such as clarinets, saxophones, oboes, bassoons, and the like, for decades. These reeds traditionally are manufactured from flexible and resilient woods which are durable in water. Most recently, these reeds are made from bamboo wood. The reeds generally have a base portion adjacent one end by which the reed is affixed to a musical instrument mouthpiece, and generally are tapered toward the other end. The taper determines the stiffness of the reed.

Reeds are generally provided in a variety of stiffnesses, the stiffer reeds provide a more desirable tone for the instrument, but generally require a more experienced player to use the reeds.

Instrument reeds made of bamboo always dry out when not in use. Dry reeds are less flexible; and thus, players must always moisten reeds prior to every playing session. Traditionally, this is accomplished by the player sucking on the reeds prior to mounting the reed in the mouthpiece and continually moistening the reed when mounted in the mouthpiece with his/her saliva during use. This reed preparation is regarded by many musicians as not being pleasurable as the reeds do not taste very good, and, additionally, many players do not appropriately moisten their reeds prior to playing.

It is therefore desirable to provide an improved musical instrument reed.

It is also highly desirable to provide an improved musical instrument reed by which moistening the reed prior to playing is encouraged.

It has also been traditionally difficult to encourage young players to practice their musical instruments. Parents are replete with stories as to how they encourage their children to practice. It is therefore highly desirable to provide an improved musical instrument reed which encourages children to practice their musical instruments.

Some children and adolescents have always chewed chewing gum or had other flavored candies, breath mints, etc., in their mouths while playing their musical instrument. However, all experienced musicians know how destructive food particles and some dissolved sugars and flavorants are to musical instruments. It is therefore highly desirable to provide an improved musical instrument reed with flavorant which does not damage the musical instrument.

Finally, as with regard to all flavorants, whether a part of chewing gum, candies, or the like, there is a problem that with use, the flavorant is dissolved by one's saliva and the flavor disappears with use. While all flavorants will disappear in time, it is highly desirable to provide an improved musical instrument reed which is flavored with flavorant which is relatively long lasting and will last as long as the reed.

SUMMARY OF THE INVENTION

It is therefore an object of the invention to provide an improved musical instrument reed.

It is also an object of the invention to provide an improved musical instrument reed by which moistening the reed prior to playing is encouraged.

It is also an object of the invention to provide an improved musical instrument reed which encourages children to practice their musical instruments.

It is also an object of the invention to provide an improved musical instrument reed with flavorant which does not damage the musical instrument.

It is also an object of the invention to provide an improved musical instrument reed which is flavored with flavorant which is relatively long lasting and will last as long as the reed.

Finally, it is an object of the invention to provide an improved musical instrument reed which has all of the above desired features.

In the broader aspects of the invention, there is provided a reed for a musical instrument comprising a reed body having opposite ends. One end being adapted to be mounted in a mouthpiece of a musical instrument. The other end is tapered from a position remote of the one end toward the other end to give to the reed the required stiffness adjacent the other end. A flavoring is absorbed into the reed body. The flavoring being concentrated at the other end.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 2:
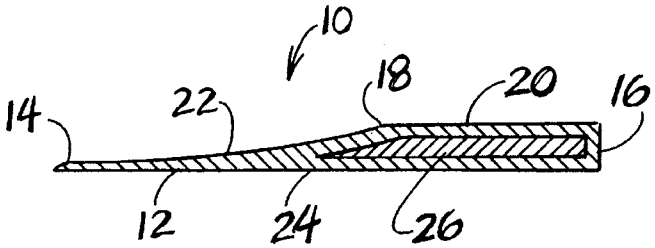
FIG. 2 is a cross-sectional view of a musical instrument reed taken substantially along section line 2—2 of FIG. 1.
Figure 1:
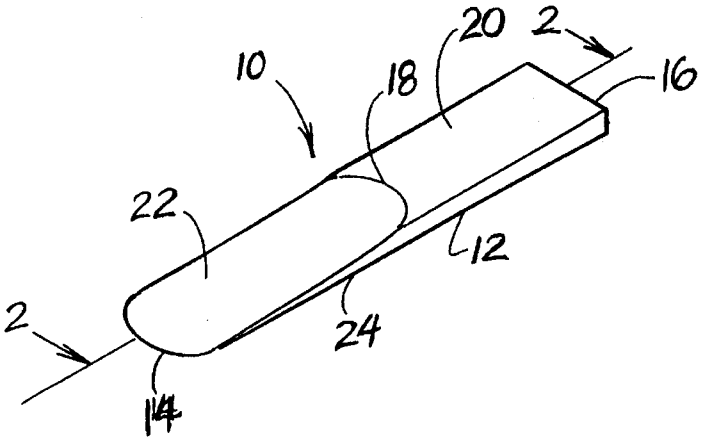
FIG. 1 is a perspective view of the musical instrument reed of the invention.

The improved musical instrument reed 10 of the invention is shown in FIGS. 1 and 2. Reed 10 bas a reed body 12 having opposite ends 14 and 16. Adjacent end 16, reed body 12 is adapted to be mounted into a mouthpiece of a musical instrument. Adjacent end 14, the reed body 12 is tapered from position 18 to end 14 an amount which determines the flexibility of reed 10. Reed body 12 has generally flat bottom 24 and a top shaped by the mount 20 and the taper 22.

Reed 10 of the invention is substantially impregnated by one or more water soluble flavorants. In a specific embodiment, body 12 is also impregnated with one or more water soluble food colorants. In one embodiment, the water soluble flavorants are combined with the food colorants. Impregnation may be accomplished by soaking the reed 10 in a water solution of flavorant and/or colorant, or by well known vacuum impregnation techniques.

It may be thought preferable to uniformly impregnate the entire reed body 12. Surprisingly, it is preferred to impregnate the entire body 12 adjacent the tapered portion 22 and end 14 but to only surface impregnate the mount or reservoir 20 adjacent end 16 and to leave an unimpregnated central portion 26 therein. Thus, in a preferred embodiment, tapered portion 22 is totally flavored and/or totally colored, and mount or reservoir 20 is partially flavored and/or partially colored. Central portion 26 extends from adjacent position 18 to adjacent end 16. While it is not precisely known all of the features of the central portion 26, it is believed that central portion 26 maintains all of the desirable properties of reed body 12 in an unflavored condition in reed 10, yet provides an adequate flavoring of reed body 12 and, of course, conserves on both flavorant and colorant as the case may be. With reed body 12 of the flavored reed 10 of the invention utilizing central portion 26, in any event, it has been found that reed 10 has all of the properties of an unflavored reed as regards to tone quality, stiffness, flexibility and life.

In a specific embodiment, reed body 12 has its flavoring and/or coloring concentrated adjacent end 14. This advantageously provides more flavoring adjacent end 14, as this is the portion of the reed 10 that will be most subject to one's saliva during use. This may be accomplished in a specific embodiment by drying the reed 10 after impregnation by hanging the reed from end 16 downwardly and allowing gravity to move the flavorant and/or colorant toward end 14.

In a specific embodiment, flavorants are conventional food flavorants and surprisingly, those flavorants and colorants which are preferred are those without alcohols to enhance their solubility. In a specific embodiment, the colorants have a relationship to the flavorant to suggest the flavorant.

In operation, the reed 10 is mounted in a mouthpiece of a musical instrument like any other musical instrument reed. The reed 10 is also used like any other musical instrument reed. The difference in the use of reed 10 of the invention from any other musical reed is that the reed 10 is flavored. In a specific embodiment, the reed 10 is also colored. During use, the flavoring is dissolved by one's saliva, much like the flavoring of a stick of chewing gum.

During use of both reed 10 and a conventional musical instrument reed, the player maintains the reed in a moist condition to maintain the desired flexibility of the reed. The musician thus usually sucks on the reed with the reed being held adjacent end 16. Repeatedly, the musician places the reed in his/her mouth and moves the reed out of the mouth causing the lips and the tongue to wipe the reed from end 16 toward end 14. This "lapping motion" will be mentioned hereinafter.

Reed 10 of the invention loses its flavoring, and, in a specific embodiment, its coloring during use. Much like the use of a stick of chewing gum, after a while, the flavorant and/or the colorant becomes less intense, and, if used for a prolonged period of time, the flavorant and/or colorant will substantially disappear from the reed 10. Reed 10 of the invention, however, has a structure which prolongs the flavoring and the coloring in the reed for essentially the life of the reed 10.

Typically, as tapered portion 22 of the reed 10 adjacent end 14 is in the user's mouth and in proximate contact with the musician's saliva, both the flavorant and/or colorant will disappear from adjacent end 14 more readily than adjacent the other end 16. By the "lapping motion" above mentioned flavorant and/or colorant tends to move from adjacent end 16 toward end 14, replenishing the flavorant and colorant removed from reed 10 adjacent end 14. Thus, mount 20 functions as a flavorant and colorant reservoir. This feature of reed 10 of the invention is indeed surprising as the flavorant and/or colorant of reed 10 lasts longer than that reasonably expected. In fact, it bas been found that the flavoring and/or coloring lasts as long as the reed 10 practically lasts for use as a musical instrument reed.

The musical instrument reed of the invention will encourage moistening of the reed prior to playing, will encourage practicing, will not damage the instrument, and the flavorant and colorant will last as long as the reed lasts for all practical purposes.

While a specific embodiment of the invention has been shown and described herein for purposes of illustration, the protection afforded by any patent which may issue upon this application is not strictly limited to the disclosed embodiment; but rather extends to all structures and arrangements which fail fairly within the scope of the claims which are appended hereto:

What is claimed is:

1. A reed for a musical instrument comprising a reed body having opposite ends, one of said ends being adapted to be mounted in a mouthpiece of a musical instrument, the other of said ends being tapered from a position remote of said one end toward said other of said ends, said reed body being impregnated with a water solution of a water soluble based flavorant, said flavorant being concentrated at said other of said ends.

2. The reed of claim 1 wherein said reed body is also impregnated with colorant, said colorant being concentrated at said other of said ends.

3. The reed of claim 1 wherein said reed body in cross-section is totally flavored at said other of said ends.

4. The reed of claim 1 wherein said reed body in cross-section is partially flavored at said one of said ends.

5. The reed of claim 4 wherein said reed body has a centrally portion adjacent said one of said ends in which there is no flavorant.

6. The reed of claim 5 wherein said central portion extends from adjacent said one of said ends to a position between said ends.

7. The reed of claim 1 wherein said reed body in cross-section is totally colored at said other of said ends.

8. The reed of claim 1 wherein said reed body in cross-section is partially colored at said other of said ends.

9. The reed of claim 8 wherein said reed body has a centrally portion in which there is no colorant.

10. The reed of claim 1 wherein said flavorant is concentrated at the exterior surface of said reed body.

11. The reed of claim 1 wherein said reed body is of bamboo wood.

12. The reed of claim 2 wherein said colorant is food coloring.

13. The reed of claim 2 wherein said colorant is concentrated at the exterior surface of said body.

14. The reed of claim 1 wherein said flavorant has no alcohol therein to render said flavorant water soluble.

15. The reed of claim 1 wherein said flavorant at said one of said ends replaces and enhances said flavorant adjacent said other of said ends by the lapping motion of a musician.

16. The reed of claim 2 wherein said colorant at said one of said ends replaces and enhances said colorant adjacent said other end by the lapping motion of a musician.

17. A reed for a musical instrument comprising a reed body having opposite ends, one of said ends being adapted to be mounted in a mouthpiece of a musical instrument, the other of said ends being tapered from a position remote of said one of said ends toward said other of said ends, said reed body being impregnated with a water solution of water soluble flavorant, said flavorant being concentrated at said other of said ends, said flavorant adjacent said one of said ends having a reservoir of flavorant at said other of said ends, said flavorant adjacent said one of said ends migrating toward said other of said ends by the lapping motion of a musician using said reed.

18. A reed for a musical instrument comprising a reed body having opposite ends, one of said ends being adapted to be mounted in a mouthpiece of a musical instrument, the other of said ends being tapered from a position remote of said one of said ends toward said other of said ends, said reed body being impregnated with a water solution of a water soluble flavorant, said flavorant being concentrated at said other of said ends, said flavorant adjacent said one of said ends being a reservoir of flavorant for said other of said ends, said flavorant adjacent said one of said ends migrating toward said other of said ends by the lapping motion of a musician using said reed, said reed body being also impregnated with a water solution of a water soluble colorant, said colorant being concentrated at said other of said ends, said body in cross-section being totally flavored at said other of said ends, said body in cross-section being partially flavored at said one of said ends, said body in cross-section being totally colored at said other of said ends, said body in cross-section being partially colored at said other of said ends, said body having a centrally located portion in which there is no colorant and no flavorant, said flavorant being concentrated at the exterior surface of said body, said colorant being food colorant, said colorant being concentrated at the exterior surface of said body, said flavorant at said one of said ends replacing and enhancing said flavorant adjacent said other of said ends by the lapping motion of a musician using said reed, said colorant at said one of said ends replacing and enhancing said colorant adjacent said other of said ends by the lapping motion of a musician using said reed.

* * * * *